US008408552B2

(12) United States Patent
Sardo

(10) Patent No.: US 8,408,552 B2
(45) Date of Patent: Apr. 2, 2013

(54) INTERLOCKING GAME CHIPS

(76) Inventor: Peter Sardo, Calabasas, CA (US)

( * ) Notice: Subject to any disclaimer, the term of this patent is extended or adjusted under 35 U.S.C. 154(b) by 75 days.

(21) Appl. No.: 13/193,341

(22) Filed: Jul. 28, 2011

(65) Prior Publication Data

US 2012/0025465 A1 Feb. 2, 2012

Related U.S. Application Data

(60) Provisional application No. 61/368,571, filed on Jul. 28, 2010.

(51) Int. Cl.
*A63F 3/00* (2006.01)

(52) U.S. Cl. ..... 273/290; 273/289; 40/27.5; D21/390

(58) Field of Classification Search ..... 273/290, 273/289; 40/27.5; D21/390
See application file for complete search history.

(56) References Cited

U.S. PATENT DOCUMENTS

| | | | | |
|---|---|---|---|---|
| 2,429,020 | A | 10/1947 | Friedman | |
| D151,758 | S * | 11/1948 | Hart | D21/390 |
| 3,228,555 | A * | 1/1966 | Pinto | 221/199 |
| 7,506,757 | B1 | 3/2009 | Ater et al. | |
| 2005/0274853 | A1 | 12/2005 | Ung | |
| 2006/0101676 | A1 * | 5/2006 | Ratmansky et al. | 40/27.5 |

* cited by examiner

*Primary Examiner* — Benjamin Layno
(74) *Attorney, Agent, or Firm* — Scott R. Hansen; Fulwider Patton LLP

(57) ABSTRACT

A poker or game chip has an outer ring and an inner disk. The inner disk is typically engaged with the outer ring, but may be disengaged by pushing on the inner disk. When the chips are in a stack, pushing on an inner disk causes it to disengage with the outer ring, and engage in the outer ring of an adjacent chip. In a stack of chips, all of the chips may have a moveable inner disk and, upon application of pressure, may be shifted to engage with the outer rim of an adjacent chip, thereby causing the stack of chips to lock. A stack of chips is thereby secured together, so that the chips will not easily disengage and spread along the top of the table.

21 Claims, 4 Drawing Sheets

INTERLOCKING GAME CHIPS

CROSS-REFERENCE TO RELATED APPLICATIONS

The present application claims the benefit of U.S. Provisional Application No. 61/368,571, filed Jul. 28, 2010, which is incorporated by reference herein in its entirety.

FIELD OF THE INVENTION

The present invention relates to chips for games, and has particular application to games in which stacks of chips can be used during the play of the game.

BACKGROUND

While playing card games such as poker, players typically use stacks of chips. For example, players are often moving stacks of chips to different locations on the table, to place bets or to collect winnings. The chips are normally stacked one atop of another, but are prone to tipping over. When a stack tips over, the chips often scatter and spread across the table. The player must stop play and stack the chips again, thereby interfering with and slowing the rate of play.

Consequently, it would be desirable to have poker or game chips that can be stacked such that the chips are not prone to tipping over as they are moved about the board.

SUMMARY OF THE INVENTION

According to one embodiment of the invention, a set of interlocking chips has a first chip having an outer ring that has an inner rim. The inner rim has at least one indentation. The first chip also has an inner disk having at least one locking member. The inner disk is also movably secured to the outer ring. A second chip has an outer ring that has an inner rim, the inner rim having at least one indentation.

The first chip has a first stand-alone chip mode in which the locking member of the inner disk is engaged with the indentation of the first chip. The first chip also has a second, locked stack mode in which the locking member is engaged with the indentation of the second chip.

Specific embodiments may have one or more particular features. In one embodiment, the locking member is biased outwardly from the inner disk. The second chip may also have a moveable inner disk, although in some embodiments the second chip may have no inner disk at all but rather have, for example, an opening for receiving an inner disk of another chip stacked upon it. The locking member may be one or more ball bearings, or may be of another design that will accomplish locking of the inner disk to an outer rim. In one embodiment, the indentation extends around a periphery of an inner rim.

The chip may be made from any of a variety of different materials, such as plastic, clay, a composite, or other materials suitable for game chips. The chip is typically round in shape, although it may alternatively be elliptical or have another shape. The outer ring of the first chip may stack upon and engage with the outer ring of the second chip by having, for example, compatible surface shapes.

In one embodiment, the inner disk of the first chip is connected to the outer ring of the first chip by at least one of: wires, straps, springs, a member extending from outer ring to inner disk, magnets, hook-n-loop material. For example, in one embodiment a wire or strap is secured on one end to the outer ring of the first chip, and is secured on the other end to the inner ring of the first chip.

The set may also optionally include a rack that has an opening on at least one end suitable for receiving an inner disk.

One embodiment of a method of interlocking a set of such chips includes the steps of disengaging the inner disk of the first chip from the outer rim of the first chip and then engaging the inner disk of the first chip with the outer rim of the second chip, thereby locking the inner disk into the outer rim of the second chip.

In one specific embodiment, a set of interlocking chips has a first chip having an outer ring having an inner rim, the inner rim having an indented track extending around the inner rim. An inner disk having a plurality of locking members that are biased outwardly from the inner disk, the inner disk being movably secured to the outer ring. The set includes a second chip having an outer ring that has an inner rim, the inner rim having an indented track extending around the inner rim of the second chip. The second chip also has an inner disk that is movably interconnected with the outer ring of the second chip. The first chip has a first mode in which the locking members of the first chip are engaged with the track on the inner rim of the first chip. The first chip also has a second mode in which the locking members of the first chip are engaged with the track on the inner rim of the second chip, and the inner disk of the second chip is disengaged with the track on the inner rim of the second chip.

Other objects, features and advantages of the invention will become apparent from a consideration of the following detailed description, the drawings, and the claims.

DETAILED DESCRIPTION OF THE PREFERRED EMBODIMENTS

Figure 1:
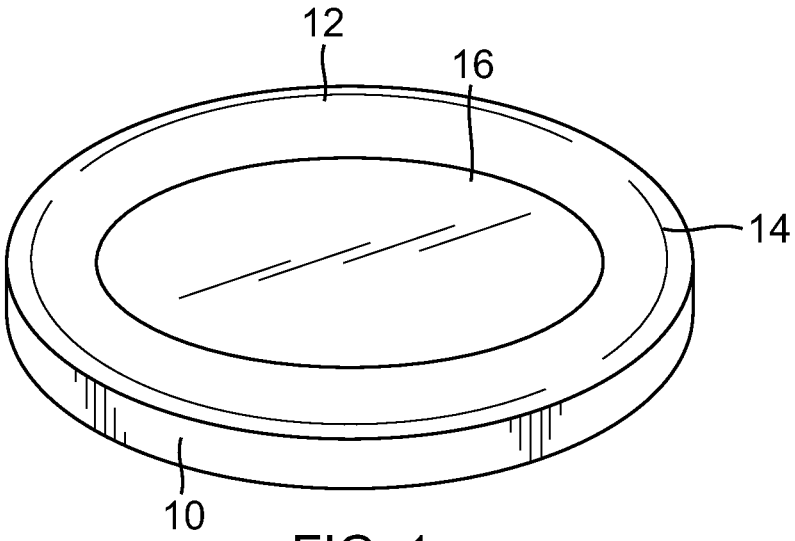
FIG. 1 illustrates one embodiment of a poker or game chip according to the present invention.

FIG. 1 illustrates a chip 10 that has an outer ring 12. Ridges 14 may be on the upper surface of the outer ring 12 so that the surface of the chips may engage when stacked. FIG. 1 also illustrates an inner disk 16 that is locked into place in the outer ring 12.

Figure 2:
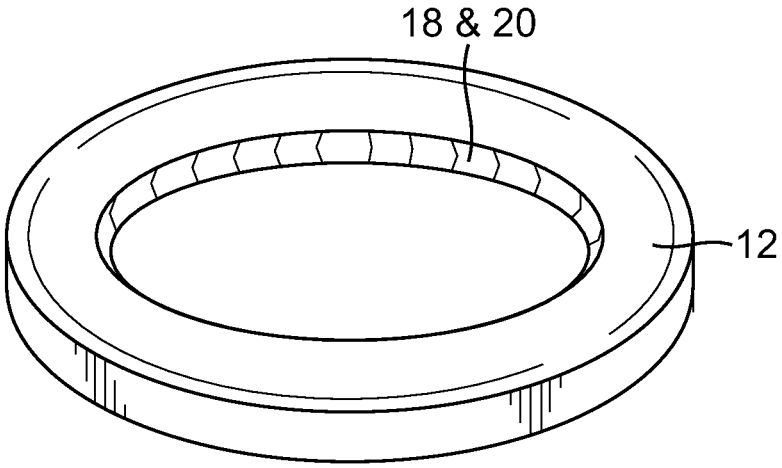
FIG. 2 illustrates the outer ring of a chip according to the present invention.

FIG. 2 is an illustration of an outer ring 12 having an inner rim 18 that is typically an indentation 20 that extends around the inside edge of the outer ring. The outer ring may be made of any material that is common for poker or game chips, such as a plastic or clay-based material.

Figure 3:
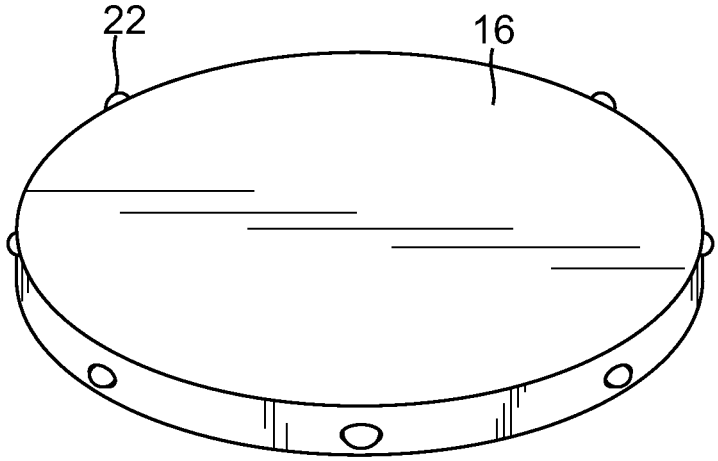
FIG. 3 illustrates an inner disk having at least one locking member, with attachment wires not shown for clarity.

FIG. 3 illustrates the inner disk 16. In this embodiment the inner disk 16 has multiple locking members, which in this embodiment are ball bearings 22. The ball bearings are typically biased outwardly, such as by compression springs. As will be seen in FIG. 4, the inner disk 16 may include attachment members such as wires or straps 28, which are omitted from FIG. 3 for clarity.

Figure 4:
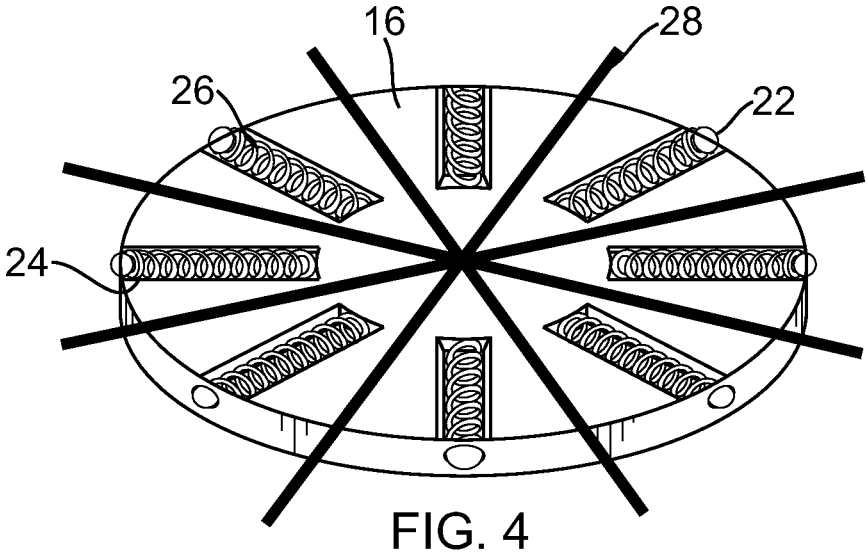
FIG. 4 is a cross section of the inner disk of FIG. 3.

FIG. 4 is a cross section of the inner disk of FIG. 3. FIG. 4 illustrates a plurality of ball bearing recesses 24. In each ball bearing recess 24 is a compression spring 26 and a ball bearing 22. The compression spring 26 biases the ball bearing outwardly, but the opening in the inner disk is of sufficiently small diameter so that only a portion of the ball bearing 22 will protrude when the ball baring is fully extended outwardly. Attachment wires or straps 28 are embedded in the inner disk 16. The attachment wires extend from the inner disk 16 to the outer ring 12, thereby attaching the outer ring to the inner disk. Thus, even when the inner disk 16 is disengaged from the outer ring 12, the attachment wires 28 will retain the inner disk.

Figure 5:
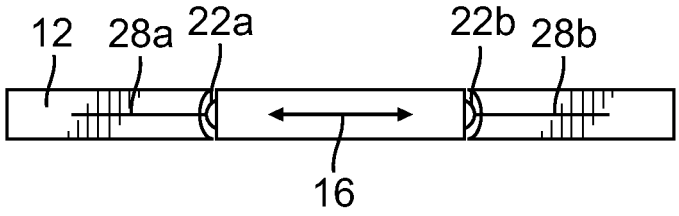
FIG. 5 illustrates the inner disk locked into place in an outer ring.

FIG. 5 illustrates the inner disk 16 engaged with the outer ring 12. The ball bearings such as 22*a* and 22*b* protrude outwardly from the inner disk 16 and engage in the recess 18 along the inner rim of the outer ring 12 attachment wires such as 28*a* and 28*b* interconnect the inner disk 16 with the outer rim 12.

Figure 6:
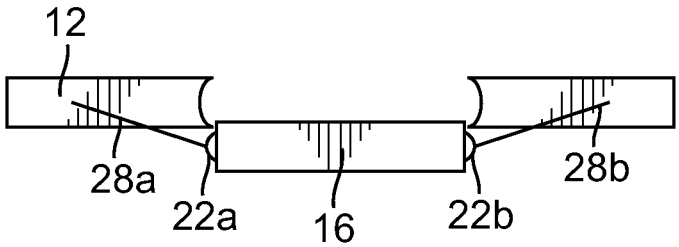
FIG. 6 illustrates the inner disk being disengaged from the outer ring.

FIG. 6 illustrates an inner disk 16 having been pushed down relative to the outer ring 12. As the inner disk 16 is pushed down, ball bearings 22*a* and 22*b* are pushed inwardly, thereby allowing the inner disk 16 to disengage from the outer ring 12. The inner disk 16 is moveably secured to the outer ring 12 by way of attachment wires 28, such that even though the inner disk is disengaged from the inner rim 18 (FIG. 2) of the outer ring, the inner disk 16 remains connected to the outer ring 12.

Figure 7:
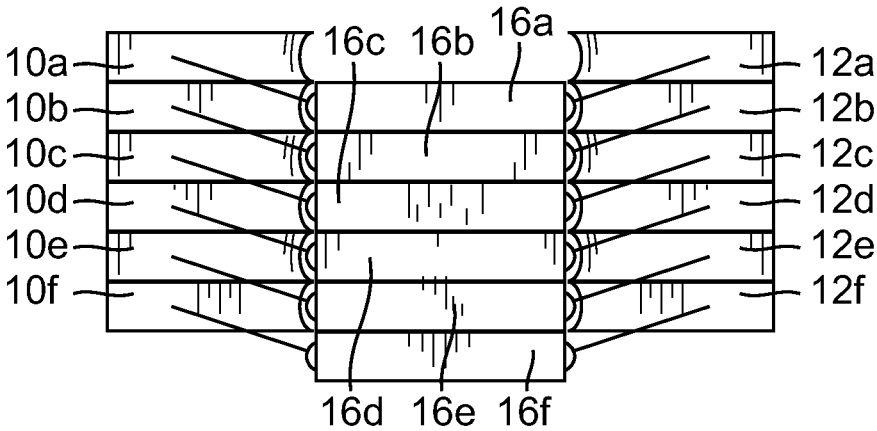
FIG. 7 illustrates a stack of interlocked chips.

FIG. 7 illustrates a stack of chips 10*a*-10*f*. Each of the respective chips 10*a*-10*f* has an inner disk 16*a*-16*f* correspondingly that has been pushed down to interlock the inner disks with the outer rings below. So for example, inner disk 16*a* is engaged with the outer ring 10*b* of the chip below. Thus, the respective inner disks 16*a*-16*e* are locked into place in corresponding outer rims 12*b*-12*f*. Inner disk 16*f* extends below the stack of chips, not locked into place on any respective outer rim. In this configuration, the stack of chips of FIG. 7 may be flipped upside down so that the inner disk 16*f* is on top and the outer rim 12*a* is at the bottom of the stack. To then unlock the stack, the user would push down on inner disk 16*f* thereby engaging inner disk 16*f* with outer rim 12*f* and the other inner disks interconnecting with the respective other outer rims. The inner disks then return to their corresponding outer disks, and the chips return to their original configuration.

The chip 10 is typically made of the same or similar materials as a typical poker chip, this may be a clay, clay composite, acrylic and/or plastic material. The weight and dimensions of the chips would be within the range of a regular poker chip. This is typically between approximately 8.5 grams and 15 grams, and having a diameter of approximately 40 millimeters and a height of approximately 4 millimeters. Variations may be made as desired for the particular setting and for the particular game that is being played.

Figure 8:
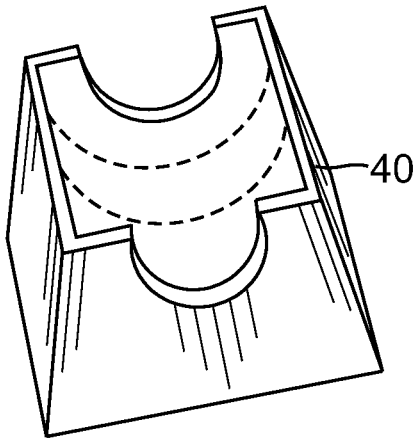
FIG. 8 illustrates a rack.
Figure 9:
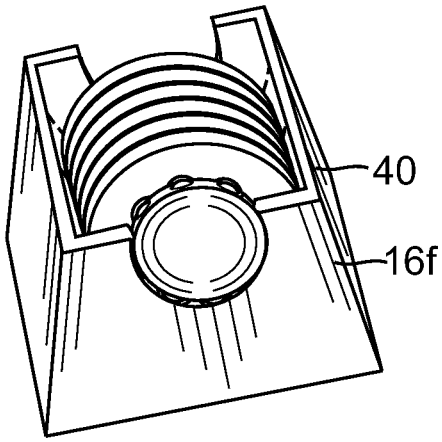
FIG. 9 illustrates a stack of chips mounted in the rack of FIG. 8.

The chips according to the present invention are uniquely able to connect and disconnect from one another easily and quickly. In one embodiment, the connection of the chips can be done with the aid of a rack. Considering FIGS. 8 and 9, a rack suitable for use with a stack of chips is illustrated in FIG. 8. With reference to both FIG. 7 and the rack of FIG. 8, when the stack of chips of FIG. 7 is inserted into the rack of FIG. 8, the inner disk 16*f* extends beyond the outer portion of the rack. This enables the stack of chips to nest neatly on the rack.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention, and that particular embodiments of the invention may have additional advantages. Therefore, it is to be understood that, within the scope of the appended claims, the invention may be practiced other than as specifically described herein.

I claim:

1. A set of interlocking chips comprising:

a first chip having an outer ring having an inner rim, the inner rim having at least one indentation;

an inner disk having at least one locking member, the inner disk being movably secured to the outer ring;

a second chip having an outer ring that has an inner rim, the inner rim having at least one indentation;

wherein:

the first chip has a first mode in which the locking member is engaged with the indentation of the first chip; and the first chip has a second mode in which the locking member is engaged with the indentation of the second chip.

2. A set of interlocking chips as defined in claim 1, wherein the locking member is biased outwardly from the inner disk.

3. A set of interlocking chips as defined in claim 1, wherein the second chip has an inner disk.

4. A set of interlocking chips as defined in claim 1, wherein the locking member is a ball bearing.

5. A set of interlocking chips as defined in claim 1, wherein the first chip has a plurality of ball bearings.

6. A set of interlocking chips as defined in claim 1, wherein the indentation extends around a periphery of an inner rim.

7. A set of interlocking chips as defined in claim 1, wherein the chip comprises plastic.

8. A set of interlocking chips as defined in claim 1, wherein the inner disk is round.

9. A set of interlocking chips as defined in claim 1, wherein the inner disk is eliptical.

10. A set of interlocking chips as defined in claim 1, wherein the outer ring of the first chip stacks upon and interconnects with the outer ring of the second chip.

11. A set of interlocking chips as defined in claim 1, wherein the second chip is free of an inner disk.

12. A set of interlocking chips as defined in claim 1, wherein the inner disk of the first chip is connected to the outer ring of the first chip by at least one of: wires, straps, springs, a member extending from outer ring to inner disk, magnets, hook-n-loop material.

13. A set of interlocking chips as defined in claim 1, wherein a wire is secured on one end to the outer ring of the first chip, and is secured on the other end to the inner ring of the first chip.

14. A set of interlocking chips as defined in claim 1, wherein the set further comprises a rack having an opening on at least one end suitable for receiving an inner disk.

15. A method of interlocking a set of chips as defined in claim 1, in which a first chip has an outer ring having an inner rim, the inner rim having at least one indentation; an inner disk having at least one locking member; and a second chip has an outer ring having an inner rim, the inner rim having at least one indentation, the method comprising the steps of:

disengaging the inner disk of the first chip from the outer rim of the first chip;

engaging the inner disk of the first chip with the outer rim of the second chip, thereby locking the inner disk into the outer rim of the second chip.

16. A set of interlocking chips comprising:

a first chip having an outer ring having an inner rim, the inner rim having an indented track extending around the inner rim;

an inner disk having a plurality of locking members that are biased outwardly from the inner disk, the inner disk being movably secured to the outer ring;

a second chip having an outer ring that has an inner rim, the inner rim having an indented track extending around the inner rim of the second chip, the second chip also having an inner disk that is movably interconnected with the outer ring of the second chip;

wherein:

the first chip has a first mode in which the locking members of the first chip are engaged with the track on the inner rim of the first chip; and the first chip has a second mode in which the locking members of the first chip are engaged with the track on the inner rim of the second chip, and the inner disk of the second chip is disengaged with the track on the inner rim of the second chip.

17. A set of interlocking chips as defined in claim 16, wherein the first chip has a plurality of ball bearings.

18. A set of interlocking chips as defined in claim 16, wherein the outer ring of the first chip stacks upon and interconnects with the outer ring of the second chip.

19. A set of interlocking chips as defined in claim 16, wherein the second chip is free of an inner disk.

20. A set of interlocking chips as defined in claim 16, wherein the inner disk of the first chip is connected to the outer ring of the first chip by at least one of: wires, straps, springs, a member extending from outer ring to inner disk, magnets, hook-n-loop material.

21. A set of interlocking chips as defined in claim 16, wherein the set further comprises a rack having an opening on at least one end suitable for receiving an inner disk.

* * * * *